US006478235B1

(12) United States Patent
Söderström et al.

(10) Patent No.: US 6,478,235 B1
(45) Date of Patent: Nov. 12, 2002

(54) DEVICE FOR THE CLEANING OF A LIQUOR SPRAY NOZZLE ASSEMBLY OF A SODA RECOVERY BOILER

(76) Inventors: Per Söderström, Kyrkbyn 187, S-825 92 Njutånger (SE); Tommy Carlsson, Idrottsvägen 4, S-825 31 Iggesund (SE)

( * ) Notice: Subject to any disclaimer, the term of this patent is extended or adjusted under 35 U.S.C. 154(b) by 0 days.

(21) Appl. No.: 09/914,844

(22) PCT Filed: Feb. 17, 2000

(86) PCT No.: PCT/SE00/00311

§ 371 (c)(1),
(2), (4) Date: Sep. 4, 2001

(87) PCT Pub. No.: WO00/52259

PCT Pub. Date: Sep. 8, 2000

(30) Foreign Application Priority Data

Mar. 3, 1999 (SE) ..... 9900753

(51) Int. Cl.[7] ..... B05B 1/28; B05B 15/02; F23D 11/38

(52) U.S. Cl. ..... 239/104; 239/106; 239/114; 239/115; 239/123

(58) Field of Search ..... 239/104, 105, 239/106, 114, 115, 116, 122, 123

(56) References Cited

U.S. PATENT DOCUMENTS

| | | | | |
|---|---|---|---|---|
| 4,653,409 A | * | 3/1987 | Eriksson | 110/182.5 |
| 4,759,299 A | | 7/1988 | Kennedy et al. | |
| 5,240,502 A | * | 8/1993 | Castaldo et al. | 239/114 |
| 5,762,005 A | * | 6/1998 | Parisi | 110/234 |
| 6,257,156 B1 | * | 7/2001 | Kaulamo | 110/163 |

FOREIGN PATENT DOCUMENTS

| | | | |
|---|---|---|---|
| JP | 06248589 A | * | 9/1994 |
| SE | 99514 B | | 7/1940 |

* cited by examiner

*Primary Examiner*—Robin O. Evans
(74) *Attorney, Agent, or Firm*—Young & Thompson

(57) ABSTRACT

A device for the cleaning of a liquor spray nozzle assembly of a soda recovery boiler which includes a liquor supply conduit (3) inserted through an opening (10) in a wall (11) of the soda recovery boiler, which conduit has a mouth (6) from which a plate (8) for distribution of liquor protrudes, more precisely from a lower part of the mouth. The device comprises a scraper element (2) which is movable reciprocally along side edges on the distributing plate (8) by a power generator (12) mounted in a supporting stand (13). The scraper element (2) comprises a U-shaped clamp (25) with a bottom piece (26) located under the distributing plate (8) as well as two side pieces (27), which are mutually spaced-apart with a distance which in the main corresponds with the width of the distributing plate.

8 Claims, 4 Drawing Sheets

Figure 1:
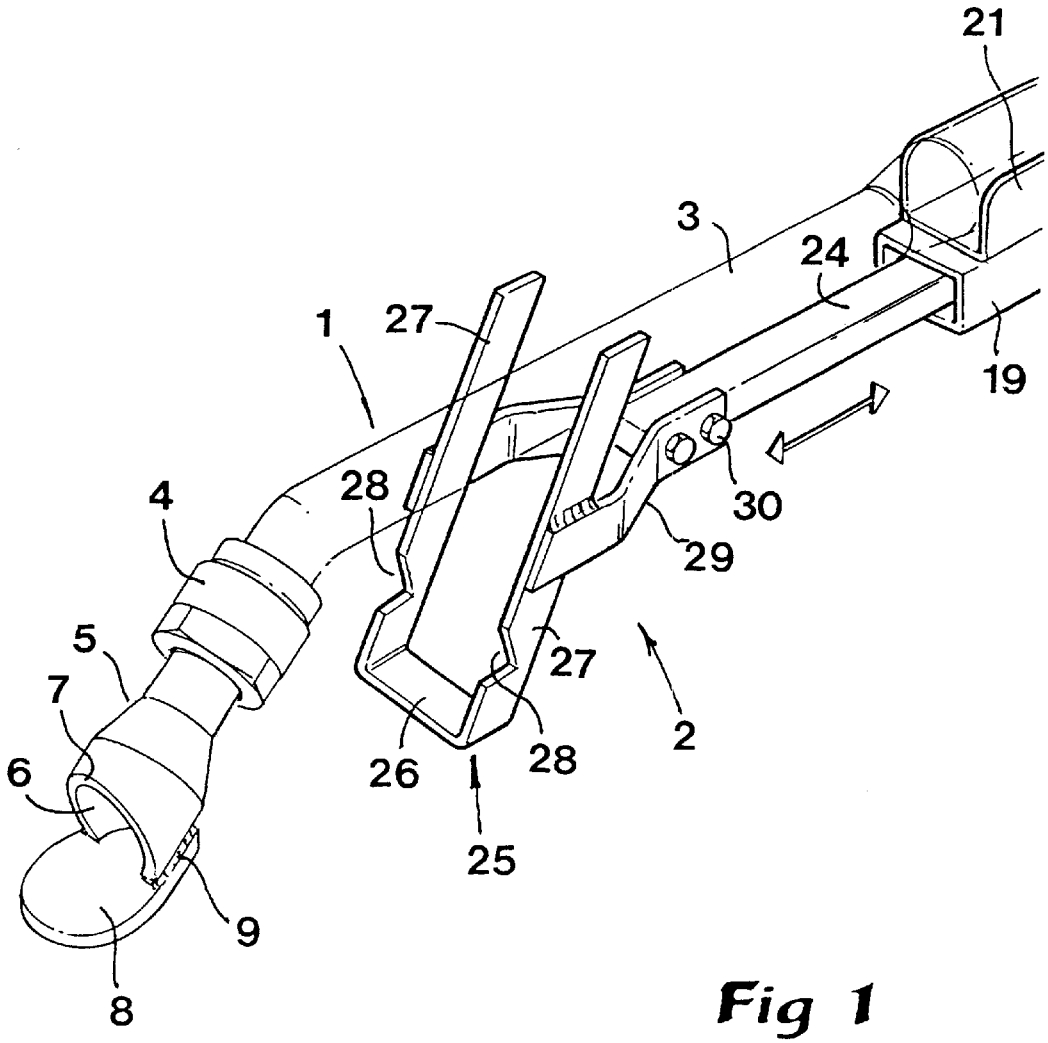

DEVICE FOR THE CLEANING OF A LIQUOR SPRAY NOZZLE ASSEMBLY OF A SODA RECOVERY BOILER

TECHNICAL FIELD OF THE INVENTION

This invention relates to a device for the cleaning of a liquor spray nozzle assembly of a soda recovery boiler of the type that includes a liquor supply conduit inserted through an opening in a wall of the soda recovery boiler, which conduit has a mouth from which a plate for the distribution of liquor protrudes, more precisely from a lower part of the mouth.

BACKGROUND OF THE INVENTION

In modern pulp mills, the major part of the cooking chemicals are recovered. After washing the pulp, the obtained waste liquor is evaporated, and then this is used as a fuel in a suitable boiler. Sulphate waste liquor (so called black liquor), and in certain case sulphite waste liquor, is burnt in a soda recovery boiler in a reducing atmosphere at approx. 1000° C. For this purpose, liquor spray nozzles of the above generally mentioned kind are used. It is important that these liquor spray nozzles give an even distribution of the injected liquor in that an uneven distribution causes a risk that the bed at the bottom of the soda recovery boiler blackens with inferior degrees of reduction and deteriorated combustion emissions as a consequence.

A problem with the liquor spray nozzles is that the liquor gets burnt and stuck adjacent to the mouth of the spray nozzles and the distributing plate connected thereto. Above all, the material sticks on the side edges and undersides of the distributing plate while forming successively growing crusts with a sticky to hard consistency. The material crusts which stick in the angular transition section between the mouth of the liquor spray nozzle assembly and the horizontal distributing plate are specially cumbersome by the fact that such crusts obstruct a distribution of the liquor laterally from the distributing plate.

In order to overcome the crust formation phenomenon, inevitable per se, manual poking or hacking has previously been resorted to. In more difficult cases, the liquor spray nozzle assembly has to be dismounted from the wall opening of the soda recovery boiler and be cleaned separately. Both these alternatives are cumbersome and laborious. Furthermore, they have a detrimental impact on the combustion process.

OBJECTS AND FEATURES OF THE INVENTION

The present invention aims at providing a cleaning device which can fulfil the purpose thereof without manual work of poking and without the need to dismount the liquor spray nozzle assembly. Thus, a primary object of the invention is to provide a cleaning device which with regular intervals makes sure that inevitable liquor material crusts are removed from the mouth and distributing plate of the liquor spray nozzle assembly without having to interrupt the operation of the liquor spray nozzle assembly. Another object is to provide a device which is simple and cheap to manufacture construction-wise. Furthermore, the device should be able to work also if the liquor spray nozzle assembly is adjusted in different angle positions in relation to the wall of the soda recovery boiler.

According to the invention, at least the primary object is attained by the features defined in the characterizing clause of claim 1. Preferred embodiments of the invention are furthermore defined in the dependent claims.

BRIEF DESCRIPTION OF THE APPENDED DRAWINGS

Figure 2:
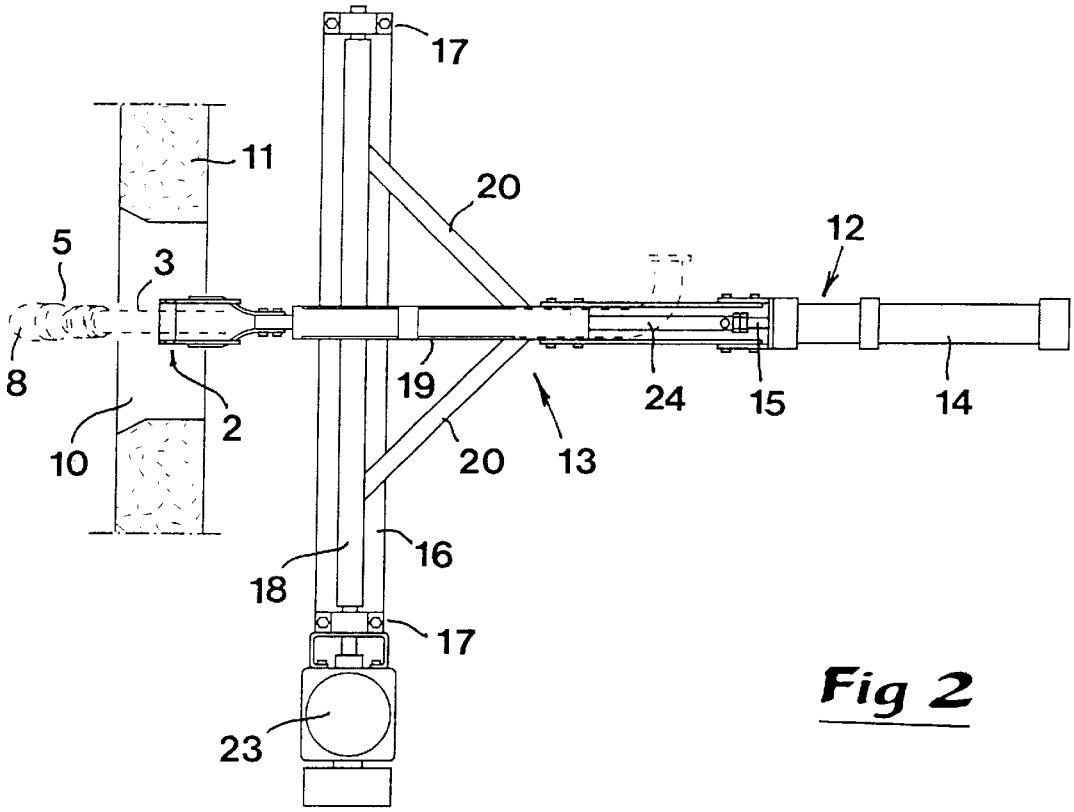
Figure 3:
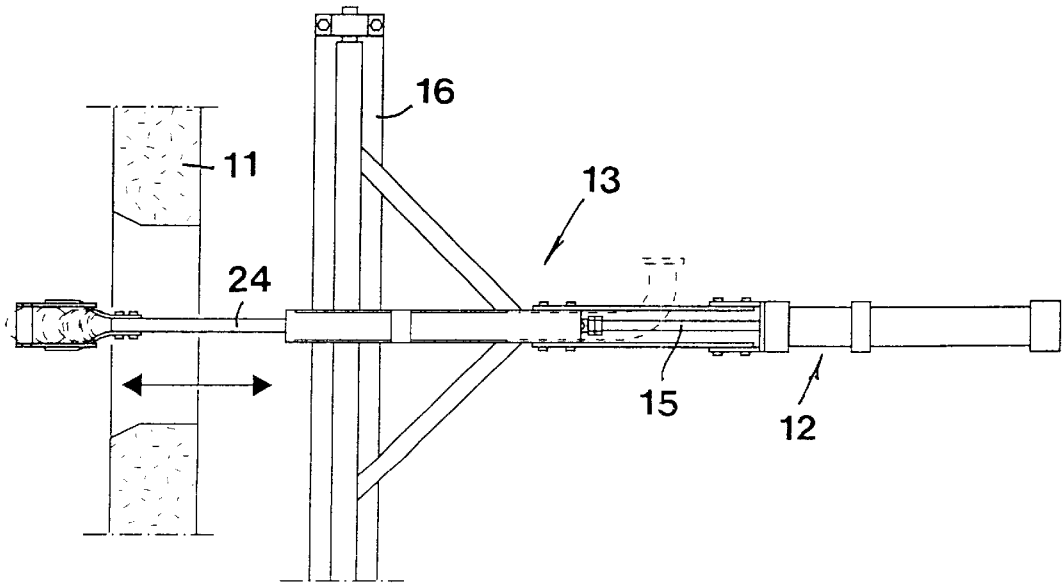
Figure 4:
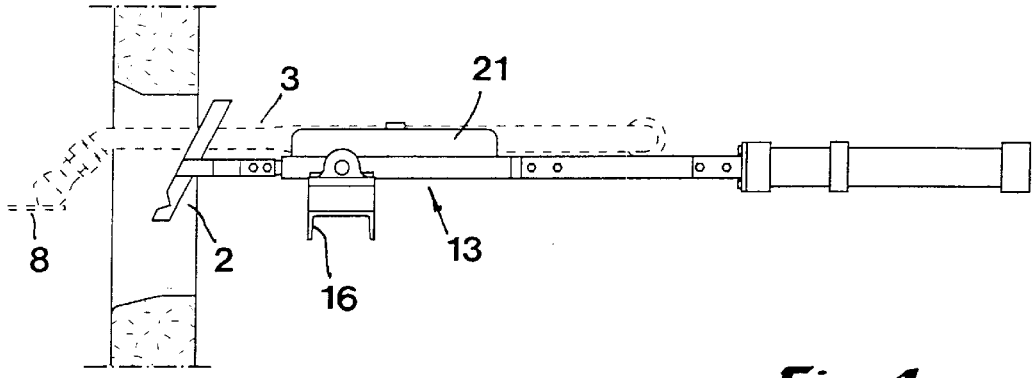
Figure 5:
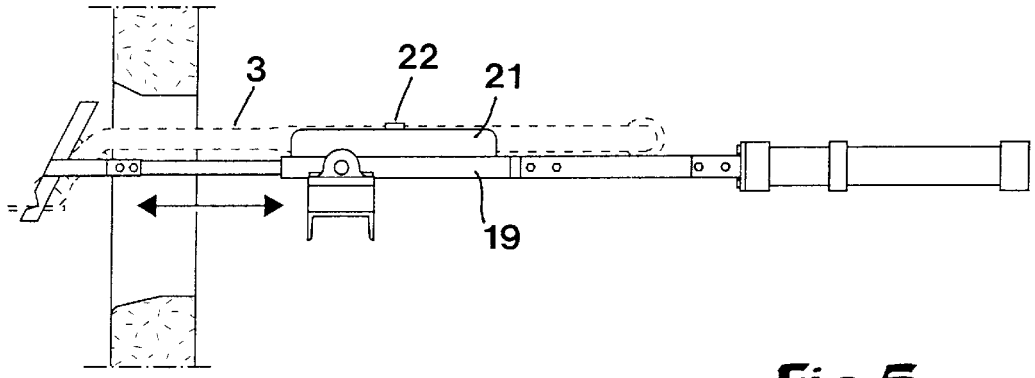
Figure 6:
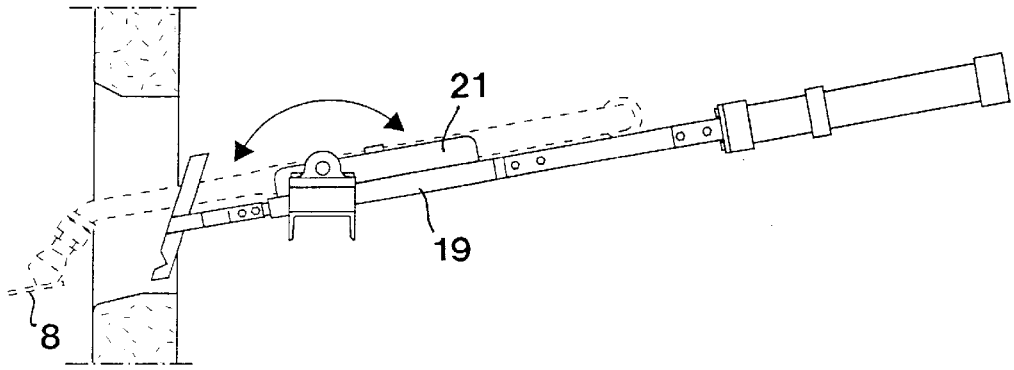
Figure 7:
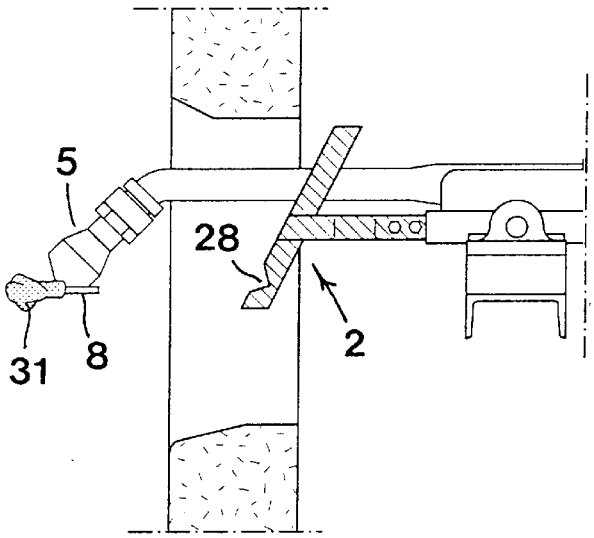
Figure 8:
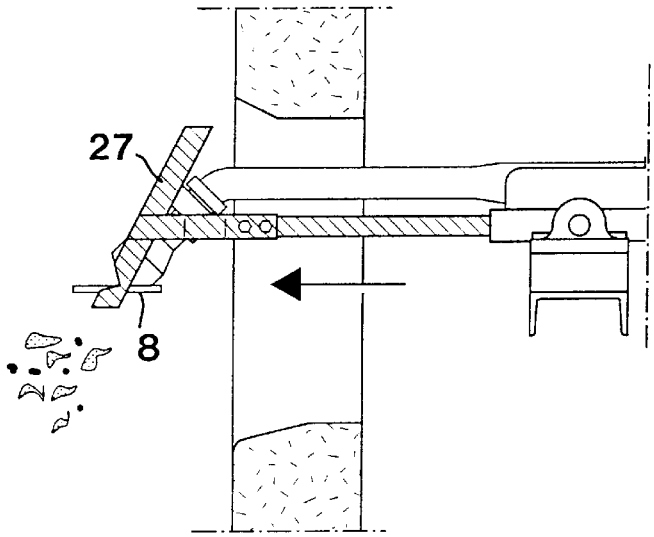
Figure 9:
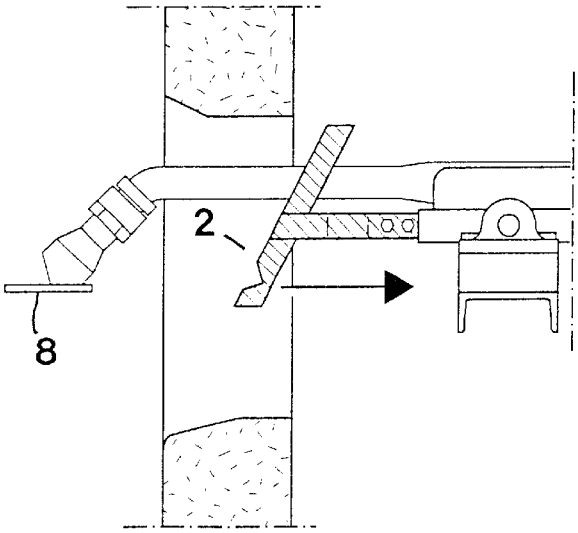

In the drawings:

FIG. 1 is a partial perspective view showing a scraper means included in the device according to the invention adjacent to a mouth of a liquor spray nozzle assembly, FIG. 2 is a planar view from above of the device in a first functional position, FIG. 3 is a corresponding planar view showing the device in a second functional position, FIG. 4 is a side view of the device in the functional position according to FIG. 2, FIG. 5 is a corresponding side view of the device in the second functional position according to FIG. 3, FIG. 6 is a side view showing the device in an oblique operation position, FIG. 7 is an enlarged, partial side view according to FIG. 4, FIG. 8 is a corresponding side view showing the position according to FIG. 5, and FIG. 9 is a side view showing how the scraper means of the device is returned from the mouth of the liquor spray nozzle assembly to an initial position.

DETAILED OF A PREFERRED EMBODIMENT OF THE INVENTION

In FIG. 1, numeral 1 generally designates a liquor spray nozzle assembly in connection with which a scraper means is shown, in its entirety designated 2, which is included in the cleaning device according to the invention. In a conventional way the liquor spray nozzle assembly 1 comprises a pipe 3 which, via a bend and a coupling 4, transforms into a nozzle 5. In this nozzle, there is a mouth 6 being delimited by a substantially horseshoe-shaped edge surface 7. Under the mouth 6, there is a plate 8 having the purpose of distributing the liquor fed out of the nozzle. The contour or the edge surface of this plate 8 has a drop-like shape. At a rear, narrow end portion, the distributing plate 8 is united to the nozzle via a welded joint 9. The angle between the distributing plate and the edge surface 7 of the mouth may vary, but should be somewhat smaller than right-angled, e.g. within the range of 75–85°.

Reference is now made to the other drawing figures from which is seen that a front part of the liquor spray nozzle assembly 1 is mounted in an opening 10 in a wall 11 of a soda recovery boiler. More precisely, the liquor spray nozzle assembly is located in such a way that the nozzle 5 protrudes a distance at the inner side of the inside of the boiler wall.

The scraper means 2 shown in FIG. 1 is movable reciprocally in relation to the nozzle by means of a power generator 12 (see FIG. 2), which is mounted in a supporting stand generally designated 13. The power generator 12 may advantageously be a pneumatically working piston-cylinder mechanism, the cylinder of which is designated 14 and the rod piston of which is designated 15.

The supporting stand 13 comprises a main girder 16 extending transversely to the liquor supply conduit 3, which girder is fixed in a suitable way in a fixed position outside of the recovery boiler wall 11. At opposite ends of the main girder 16, there are plummer blocks 17 in which a shaft 18 is rotatably mounted. In a central area, the shaft 18 is connected to a box girder 19. In practice, the shaft 18 may consist of two parts, e.g. square profiles, which are welded to opposite side surfaces of the box girder 19. These shaft halves are connected to the box girder 19 also via two diagonal members 20, preferably by means of welded joints. On the top side of the box girder 19, an upwardly open U-girder 21 is applied in which the liquor supply conduit 3 is mounted. The conduit 3 may be locked in the U-girder 21 by means of a schematically indicated locking device 22 (see FIG. 5). By the fact that the shaft 18 is revolving in relation to the appurtenant plummer blocks, the stand 13 may in its entirety be turned at least somewhat between different adjustment positions, as is outlined in FIG. 6. In order to permit a turning motion of the supporting stand, the liquor supply conduit 3 is, in a way not shown, connected to a main supply conduit via a swivel connection, a hose or the like.

As may be seen in FIG. 2, the shaft 18 is, at one end thereof, connected to an actuator 23 having the purpose of attending to the revolution of the shaft.

The scraper means 2, according to FIG. 1, is mounted on a front end of a shank 24 running through the box girder 19, which shank at the rear end thereof is connected to the rod piston 15. The scraper means comprises a U-shaped, upwardly open clamp 25, which is composed of a bottom piece 26 and two side pieces 27 directed obliquely upwards/backwards therefrom. The length of the bottom piece 26—and thereby the distance between the side pieces 27—is only slightly larger than the maximum width of the distributing plate 8. This means that the side pieces 27 may sweep past the side edges of the distributing plate at an extremely short distance (e.g. 0,5–1,5 mm) therefrom. In a front edge on each individual side piece 27, a recess 28 is provided, which is V-shaped and delimited by two edge surfaces oriented at the same angle towards each other as the angle between the mouth edge surface 7 of the nozzle 5 and the distributing plate 8. Thus, the angle between the edge surfaces of the recessions 28 may be somewhat less than 90°. The clamp 25 is connected to the shank 24 via cranked cantilever pieces 29. More precisely, one end of the individual cantilever piece is welded to a side piece 27, while the opposite end is connected to the shank via screw joints or bolt joints 30. As may be seen in FIG. 1, the shank 24 may advantageously consist of a box girder which is somewhat thinner than the external box girder 19.

The Function of the Device According to the Invention

In FIGS. 2, 4 and 7, the scraper means 2 is shown in a starting position in which the shank 24 is maximally withdrawn, more precisely by the fact that the rod piston 15 is fully inserted in the cylinder 14. In FIG. 7 is outlined how a crust 31 of burnt liquor has been formed on the distributing plate 8. In practice, the crust formations are, above all, formed along the edge portions of the distributing plate and on the underside of the plate. When the crust is to be removed, the piston-cylinder mechanism 12 is activated so that the rod piston is pushed out towards an outer end position, which is illustrated in FIGS. 3, 5 and 8. When the U-clamp 25 of the scraper means is approaching the mouth 6 of the nozzle 5 and the following wide portion of the distributing plate 8, the two side pieces of the U-clamp will break loose the crust along the side edges of the plate at the same time as the bottom piece 26 of the U-clamp breaks loose the crust formations on the underside of the distributing plate in that the bottom piece 26 during the motion thereof sweeps past immediately underneath the underside of the plate. The loosening of the crust formations by scratching along the side edges of the distributing plate is guaranteed by the portion of each side piece 27 which is situated below the V-shaped recession 28. Therefore, this lower portion of each side piece may be pushed out a distance forwards from the edge surface 7 of the mouth of the nozzle without the upwardly directed edge surface of the recession passing past the edge surface 7. This means that the side pieces during the displacement thereof to the outer end position do not obstruct the distribution of the fed out liquor laterally from the mouth. This is something which is vital in order to guarantee a continuously even distribution of the liquor to the bottom of the soda recovery boiler. When the U-clamp has reached the outer end position thereof and carried out a cleaning operation by scratching, the same is returned to the starting position thereof by the fact that the rod piston 15 is again inserted in the cylinder 14 (see the arrow in FIG. 9). The above cleaning operation by scratching may be repeated either discretionary occasionally or intermittently by controlling, in a suitable way, e.g. by means of a programmer, the operation of the piston-cylinder mechanism.

If required, the angle position of the supporting stand 13 in the room, and thereby the position of the liquor spray nozzle assembly, may be varied. From the horizontal position shown in FIGS. 4 and 5, the supporting stand may be tilted for instance obliquely forwards/downwards as is illustrated in FIG. 6. This takes place by turning the shaft 18 by means of the actuator 23. By the fact that the liquor spray nozzle assembly is mounted and locked in the U-girder 21, the same automatically accompanies the stand between different angle positions.

What is claimed is:

1. Device for the cleaning of a liquor spray nozzle assembly of a soda recovery boiler of the type that includes a liquor supply conduit (3) inserted through an opening (10) in a wall (11) of the soda recovery boiler, which conduit has a mouth (6) from which a plate (8) for the distribution of liquor protrudes, more precisely from a lower part of the mouth, characterized in that the same comprises a scraper means (2), which is movable reciprocally along side edges of the distributing plate (8) by means of a power generator (12) mounted in a supporting stand (13), and which comprises a U-clamp (25) with a bottom piece (26) located under the distributing plate (8) as well as two side pieces (27), which are mutually spaced-apart with a distance which in the main corresponds with the width of the distributing plate.

2. Device according to claim 1, characterized in that a recess (28) is provided adjacent to a front edge on each individual side piece (27) of the U-clamp (25), which allows the side piece to pass a distance past the mouth (6) of the supply conduit during the cleaning by scratching of a side edge on the distributing plate (8) without the side piece obstructing the distribution of liquor laterally from said mouth.

3. Device according to claim 1, characterized in that the power generator (12) together with the scraper means (2) and the liquor supply conduit (3) are commonly mounted on the supporting stand (13), and that the supporting stand is turnably movable in relation to the wall (11) of the soda recovery boiler in order to enable adjustment of the liquor supply conduit in different angles in relation to the boiler wall, the scraper means (2) automatically accompanying the liquor supply conduit (3) and the distributing plate (8) at alterations of the angularity of the conduit.

4. Device according to claim 1, characterized in that the supporting stand (13) comprises a fixedly mounted main girder (16) extending transversely to the liquor supply conduit (3) with two spaced-apart plummer blocks (17)

between which a rotatably mounted shaft (18) extends to which a box girder (19) is connected, inside of which there is a shank (24), which at a first end is connected to the scraper means (2) and at an opposite end connected to the power generator (12).

5. Device according to claim 4, characterized in that an upwardly open U-girder (21) is arranged on top of the box girder (24), in which U-girder the liquor supply conduit (3) is detachably mounted.

6. Device according to claim 4, characterized in that said shaft (18) is connected to an actuator (23) fixedly applied to an end of the main girder (16) for turning the shaft.

7. Device according to claim 2, characterized in that the power generator (12) together with the scraper means (2) and the liquor supply conduit (3) are commonly mounted on the supporting stand (13), and that the supporting stand is turnably movable in relation to the wall (11) of the soda recovery boiler in order to enable adjustment of the liquor supply conduit in different angles in relation to the boiler wall, the scraper means (2) automatically accompanying the liquor supply conduit (3) and the distributing plate (8) at alterations of the angularity of the conduit.

8. Device according to claim 5, characterized in that said shaft (18) is connected to an actuator (23) fixedly applied to an end of the main girder (16) for turning the shaft.

* * * * *